US011511911B1

(12) United States Patent
Woodhead

(10) Patent No.: US 11,511,911 B1
(45) Date of Patent: Nov. 29, 2022

(54) WINE DRIP RING

(71) Applicant: Robert Neal Woodhead, Clam Gulch, AK (US)

(72) Inventor: Robert Neal Woodhead, Clam Gulch, AK (US)

( * ) Notice: Subject to any disclaimer, the term of this patent is extended or adjusted under 35 U.S.C. 154(b) by 0 days.

(21) Appl. No.: 17/752,276

(22) Filed: May 24, 2022

(51) Int. Cl.
*B65D 23/06* (2006.01)

(52) U.S. Cl.
CPC ..... *B65D 23/065* (2013.01)

(58) Field of Classification Search
CPC ..... B65D 47/40; B65D 23/06; B65D 23/065; B65D 59/04; B65D 2539/00; B65D 2539/001; B65D 2539/003; B65D 2539/005; B65D 2539/006; B65D 2539/008
See application file for complete search history.

(56) References Cited

U.S. PATENT DOCUMENTS 445,569 A * 2/1891 Morningstar ..... B65D 23/065 15/245
3,063,590 A * 11/1962 Peters ..... B65D 23/065 D19/1
4,437,583 A * 3/1984 O'Connor ..... B65D 23/065 215/41
6,023,883 A * 2/2000 Bacon, Jr. ..... A01G 25/02 47/48.5
6,325,247 B1 * 12/2001 Iggulden ..... B65D 41/62 428/40.1
6,718,733 B2 * 4/2004 Kilmartin ..... B65D 23/0871 53/49
7,128,243 B2 * 10/2006 Fallaha ..... B65D 51/185 215/246
7,926,851 B2 * 4/2011 Kaufman ..... B42D 15/00 283/81
8,833,611 B2 * 9/2014 Bouwer ..... B67D 1/16 215/41
10,065,782 B1 * 9/2018 Jones ..... B65D 5/42
2008/0185360 A1 * 8/2008 Zak ..... B65D 23/065 215/392
2011/0011487 A1 * 1/2011 Barnes ..... B65D 23/065 141/1
2013/0323457 A1 * 12/2013 Barringer ..... A47K 10/02 428/134
2014/0120287 A1 * 5/2014 Jacoby ..... B65B 11/00 53/461
2019/0084729 A1 * 3/2019 Zufferey ..... B65D 41/62
2022/0055786 A1 * 2/2022 Fournier ..... B65D 81/127

* cited by examiner

*Primary Examiner* — Kareen K Thomas

(57) ABSTRACT

A liquid absorbing fabric that is cut to the shape of a ring with the exact measurements and design that slips down firmly over the neck of a wine bottle. The liquid absorbing ring catches the unwanted wine drip that follows your pour of wine into a glass which usually turns into a small stream of wine running down the side of the wine bottle. The Wine Drip Ring protects the wine label, table linens and other various surfaces from wine stains; furthermore, the Wine Drip Ring is disposable when the bottle of wine is empty.

1 Claim, 1 Drawing Sheet

WINE DRIP RING

FIELD OF THE INVENTION

This invention relates to the wine accessory industry; and more particularly to a liquid absorbing fabric ring made to specific size and shape that is designed to catch unwanted wine drips that follow your pour of wine. The Wine Drip Ring protects the wine label, table linens and other multiple surfaces from wine stains with the benefit of being disposable.

BACKGROUND OF THE INVENTION

No matter how much of a wine enthusiast you are, you cannot escape the annoying wine drip that follows your pour of wine into the glass. You more than likely have noticed how inevitable it is to spill a small stream of wine down the side of the wine bottle after pouring. Nice restaurants are aware of this issue and wrap a napkin around the bottle neck to protect their table linens and the wine label from wine stains. One reason for this drip, is that liquid poured from a glass bottle tends to curl back and run down the side of the bottle because glass is hydrophilic (attracts water-based liquids). The current design of wine bottles date back to the 1800s and it is interesting that still; no new design has been developed to address the after pour drip problem. The Wine Drip Ring is a novel, low cost and disposable solution to catch the annoying drip that follows your pour of wine.

SUMMARY OF THE INVENTION

The principal objective of this invention is to provide a device that has a pleasant appearance with a liquid absorbing fabric that is cut into the shape of a ring with; the exact measurements and design that slips down firmly over the neck of a wine bottle to catch unwanted wine drips that follow your pour of wine into a glass. The Wine Drip Ring is designed and used to catch the drip to protect the wine label, table linens and other multiple surfaces from wine stains. The design and shape of the Wine Drip Ring makes the instructions for placement on the bottle immediately apparent. In addition, the Wine Drip Ring is made of an inexpensive liquid absorbing fabric that is disposable when the bottle of wine is empty.

DESCRIPTION OF THE PREFERRED EMBODIMENT OF THE INVENTION

Figure 1:
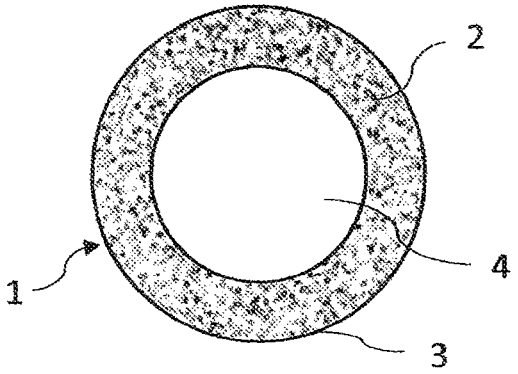
FIG. 1 is a top and bottom view of the Wine Drip Ring according to the invention.
Figure 2:
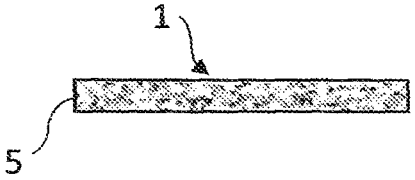
FIG. 2 is a side view of the Wine Drip Ring.
Figure 3:
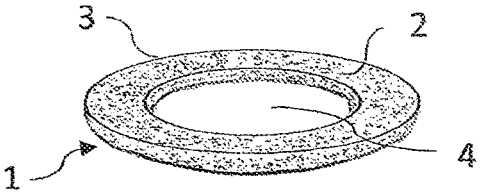
FIG. 3 is a three-dimensional (3D) view of the Wine Drip Ring.
Figure 4:
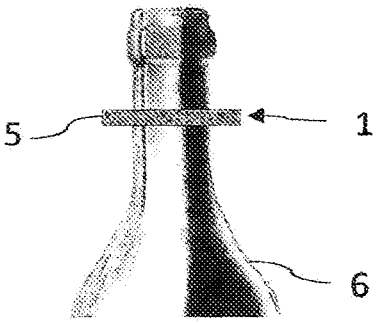
FIG. 4 depicts the position of the Wine Drip Ring on the wine bottle prior to the pour.
Figure 5:
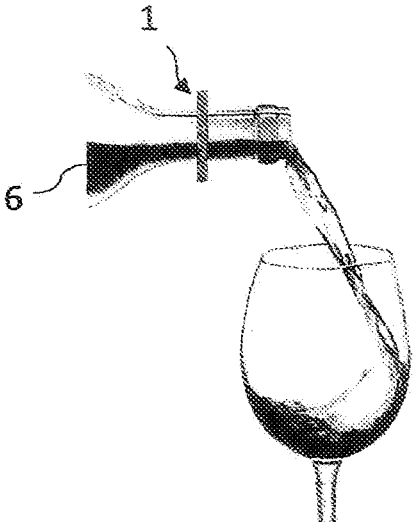
FIG. 5 illustrates the function of the Wine Drip Ring as the wine is pouring from the bottle of wine.

Referring now to the drawing, there is shown in FIG. 1 a Wine Drip Ring 1 made from a choice of colored and liquid absorbing material. The Wine Drip Ring 1 performs as required when made from felt. The characteristics of felt are ideal for the design and function of the Wine Drip Ring. The felt for the Wine Drip Ring development is available from several felt manufacturers in the US. The Wine Drip Ring 1 has a circle outline with a ring 2 design. As shown in FIG. 3, the outside 3 of the ring is approximately 44 mm in diameter (1.73 inches) and the material inside the ring is removed creating a hole 4 of approximately 27 mm (1.06 inches). The thickness 5 of the ring is approximately 4 mm (0.16 inches) as shown in FIG. 2. Custom die cutting services for felt are available to create the perfect shape and size for the Wine Drip Ring. The color of the material for the Wine Drip Ring would be a dark red burgundy to hide any drips absorbed from the pour. Accordingly, as shown in FIG. 5, the Wine Drip Ring 1 is a round ring shaped 2 design that slips down firmly over the neck of a wine bottle 6 to catch unwanted after pour drips to prevent wine stains. In addition, the Wine Drip Ring 1 is made of an inexpensive liquid absorbing fabric that is disposable when the bottle of wine 6 is empty.

What is claimed is:

1. A wine drip ring which comprises:

an absorbent felt fabric measuring 4 mm high cut in a circular shape with an outside measurement equal to 44 mm in diameter with an inside material removed, creating an internal opening of 27 mm in diameter forming a ring design that slips down firmly over a wine bottle neck which catches unwanted wine drips from wine poured into glassware, thus preventing wine dripping down a wine bottle, thereby protecting table linens and countertops from wine stains; wherein a design and shape of this single-use felt ring allows for use on various different wine bottles, wherein a color of a material for the wine drip ring is a dark red burgundy to hide any drip absorbed from pouring.

* * * * *